United States Patent [19]

Watson

[11] 4,178,726

[45] Dec. 18, 1979

[54] METHOD AND APPARATUS FOR PROTECTING THREAD ON AN EARTH ANCHOR

[76] Inventor: Gary Q. Watson, P.O. Box 1374, Del Rio, Tex. 78840

[21] Appl. No.: 931,941

[22] Filed: Aug. 8, 1978

[51] Int. Cl.[2] ..... E02D 5/74

[52] U.S. Cl. ..... 52/98; 52/161; 52/515; 85/1 C

[58] Field of Search ..... 52/160, 161, 162, 163, 52/164, 515, 98, 741; 85/1 C; 405/259, 260, 261

[56] References Cited

U.S. PATENT DOCUMENTS

| | | | |
|---|---|---|---|
| 1,907,759 | 3/1933 | Durbin | 52/161 |
| 2,399,526 | 4/1946 | Warren | 85/1 C |
| 2,576,412 | 11/1951 | Ogburn | 52/161 |
| 3,807,110 | 4/1974 | Kaminski | 52/98 |
| 3,924,371 | 12/1975 | Kidwell | 52/161 |

FOREIGN PATENT DOCUMENTS

| | | | |
|---|---|---|---|
| 747560 | 10/1953 | United Kingdom | 85/1 C |
| 1084064 | 9/1967 | United Kingdom | 52/167 |

*Primary Examiner*—James A. Leppink
*Assistant Examiner*—Henry E. Raduazo
*Attorney, Agent, or Firm*—Gunn & Lee

[57] ABSTRACT

A releaseable telescoping device for protecting the threads of a rod of an earth anchor against corrosion is shown. The releaseable telescoping device has a plurality of sheath sections of dissimilar radii connected by small radially extending flanges therebetween to resemble the external configuration of an extended telescope. An expansion plate is connected to the rod above the threads and radially extends therefrom. After packing the telescoping device with a pliable protective material, such as tar, the threaded portion of the rod is inserted in the telescoping device which has one end affixed to the expansion plate. By threading an anchor nut on the end of the threaded rod, the earth anchor is readied for insertion in the ground. Upon insertion of the earth anchor in the ground and rotating the rod, the anchor nut advances on the threads thereby shearing each radially extending flange respectively to close the telescoping device, yet still protect threads above the anchor nut.

16 Claims, 7 Drawing Figures

METHOD AND APPARATUS FOR PROTECTING THREAD ON AN EARTH ANCHOR

BACKGROUND OF THE INVENTION

The invention relates to the protection of threads on rods or bolts which will be subjected to extreme corrosion or other damaging attack. In particular, the invention includes a releaseable telescoping device which is useful in the protection of threads on each anchor rods against corrosion. The corrosion is largely due to electrolysis. Due to a larger surface area for corrosion created by threads, and due to the peaks or ridges associated therewith, stronger electric potentials are created at the location of the threads than at other points on the rod. The stronger electric potentials plus the inherent difficulty of protecting threaded surfaces causes more rapid and destructive corrosion to areas of the anchor rod which are threaded than those which are not threaded. By completely insulating the rod and thus eliminating the possibility of an electric current between soils of different chemical compositions through the rod, electrolysis (the major cause of corrosion) is prevented.

BRIEF DESCRIPTION OF THE PRIOR ART

Threaded rods of earth anchors are subject to many types of attack such as corrosion by rust or electrolysis, impact by hard objects, or having the threads "gummed up" by contact with other objects. Prior attempts have been made to protect the threads with metallurgic treatment such as galvanizing, coating with a protective substance such as asphalt, or enclosing within protecting sheathing.

Certain environments and uses of the earth anchor and threaded rod place greater demands and allow narrower parameters with respect to corrosion than normal environments. The use of anchor nuts threaded rod combinations in the form of earth anchors buried below the earth's surface presents considerable difficulties especially in highly corrosive soils.

The demands for protecting the untraversed threads of an anchor rod are severe. Because the anchors are often used to stabilize tall antennas and oil derricks, the anchors must be deeply buried in the earth and connected to the supported structure by metal rods or cables. The anchor may be in contact with different subsurface stratas containing soils with radically different electric potentials. Under these conditions, electrolysis can very rapidly act upon the exposed threads of an anchor rod and in a short time render the entire anchor useless. Extreme danger and risk are encountered when an anchor supporting a tall structure no longer performs its intended function and causes the structure to topple due to lack of support.

Further, the fact that such anchors are permanently underground places much narrower perimeters upon the means which may be used to combat the electrolytic corrosion. It is not certain how far an anchor threadably engaged to a rod might have advanced up the rod threads after the rod has been rotated at the surface. Also, there is no means of an inspecting earth anchor for corrosion once it is in place. The fact the earth anchor may have corroded to the extent that it can no longer function effectively may only be discovered when high winds or other stresses to the supported structure cause the structure to fall.

Merely applying asphalt with a brush or merely galvanizing the exposed threads of the anchor rods, while they may retard corrosion, does not offer the degree of protection as the present device. A flexible coating can be scraped away by protruding rock when the earth anchor is being inserted into the ground. An inflexible coating can crack under the same circumstances permitting corrosion, or interferance with the rod advancing through the anchor. The present invention combines a flexible inner protective substance such as tar with an outer inflexible sheathing to offer greater protection than either could provide separately.

The outer sheath retains the inner protective substance such as tar while the anchor is being inserted into the earth as still protects the threads. Once inserted and the rod is rotated to open the anchor wings, the inner protective substance continues to protect the anchor rod threads as the flanges between the different sheath sections shear and collapse in a telescoping manner. Because of the telescoping feature of the sheath sections, the device offers complete protection regardless of how many or how few rotations the rod is turned in the anchor nut. Finally, the telescoping feature allows the rod to turn freely thereby advancing the anchor nut thereon for the length of the threaded portion without the sheathing interfering with full extension of the anchor wings or clogging the threads of the rod.

SUMMARY OF THE INVENTION

The present invention solves the problem of corrosion by electrolysis of rods for earth anchors by electrically insulating the part of the rod most vulnerable to electrolytic corrosion, the threads. A releasable telescoping device containing tar or another pliable insulating material within its annular space and an expansion plate are attached to a threaded rod and an anchor nut is threadably engaged upon the threaded rod. This telescoping device in conjunction with the tar contained within it serves to protect the untraversed threads regardless of whether the rod is only rotated once inside the earth anchor nut, or is rotated many times and advances the full length of the threads.

An object of this invention is to protect the threads of a metal rod against corrosion or other types of damage. The inner layer of tar serves to protect the threads from both chemical electrolytic and other chemical corrosive attack. The telescoping portion of the device serves to keep the tar in place against the threads and to protect the tar from being scraped from position by interfering objects as the earth anchor is being placed within the earth and subsequently rotated open during the installation of the earth anchor.

It is another object that the present invention be capable of being used in combination with other electrically insulating means to insulate the full functional length of the rod. Without continuous insulation of the rod from the earth, the rod would contact soil substrates having different electric potential when combined with iron and the rod would conduct an electric current through the rod and between the different substrata. Such condution of current by the rod leads to rapid deterioration of the rod through electrolysis. Therefore, the full function and length of the rod must be continuously and impenetrably electrically insulated from the soil.

Further objects are to achieve the above with a device that is sturdy, compact, durable, simple, safe, versatile, easy to install, and reliable, yet relatively inexpensive and easy to manufacture.

Still further objects are to achieve the above with a method that is versatile, inexpensive and does not require skilled personnel to install, adjust and maintain.

DESCRIPTION OF THE PREFERRED EMBODIMENT

Figure 1:
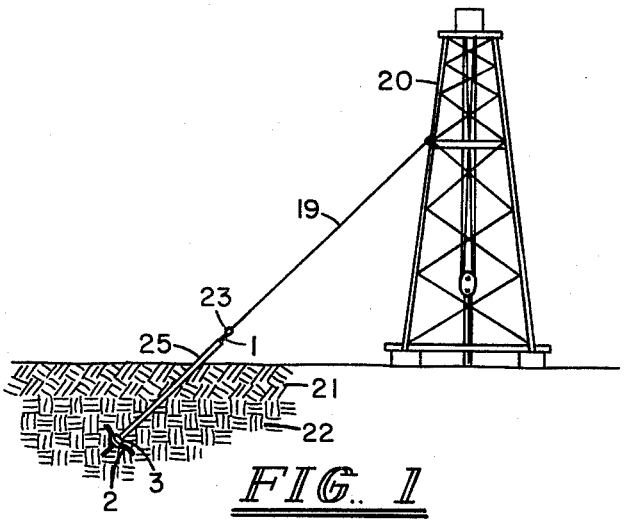
FIG. 1 is a view of an installed earth anchor supporting an oil derrick by means of a cable.

A typical installation using the present invention is illustrated in FIG. 1. Earth anchor 3 is attached by means of a rod 1, a cable eye 23, and a cable 19 to the supported structure, such as derrick 20. It is to be understood that the earth anchor shown may be used in many installations other than supporting derricks. For clarity of description, "vertical" will henceforth mean "parallel with the axis of the rod 1" and "horizontal" will mean "perpendicular to the axis of the rod 1."

The anchor 3 as shown in FIG. 1 is in its final installed position with the anchor wings 2 fully extended into the earth. A pull upon the earth anchor 3 from the cable 19 will be approximately parallel to the rod 1 as it lies within the earth. The anchor wings 2, which are spread out perpendicularly to the rod 1, are perpendicular to the direction of force upon the anchor 3 exerted by cable 19. To move the anchor 3 by cable 19 would require the movement of a large mass of earth, making it virtually impossible for the cable 19 to pull the anchor 3 from the ground once it is installed.

The soil in which the anchor 3 is buried is illustrated as having a subsurface strata 21 and a subsurface strata 22. The two stratas 21 and 22 may have different chemical compositions and therefore exert different electromotive forces especially when exposed to iron. If the rod 1 is not insulated from strata 21 and strata 22, rod 1 will operate as a conductor for electric current between strata 21 and strata 22. This electric current will cause rapid deterioration and failure of the rod 1 if allowed to continue due to electrolysis.

Figure 2:
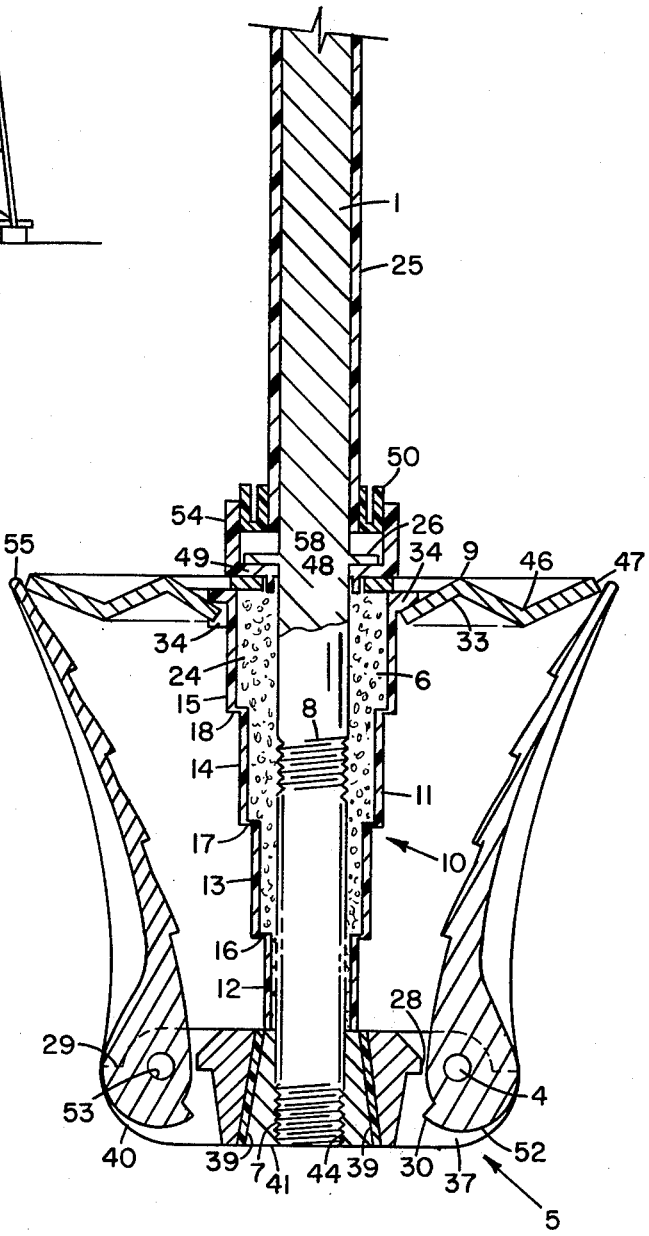
FIG. 2 is a partial elevated cross-sectional view of an earth anchor embodying the present invention prior to the earth anchor being installed.
Figure 4:
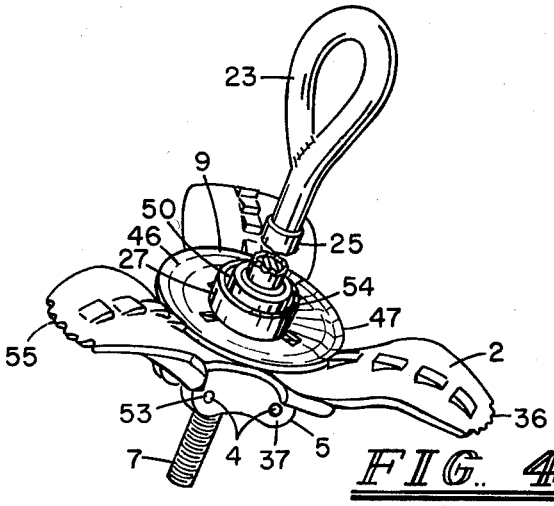
FIG. 4 is a perspective view of the 3-wing earth anchor shown in FIG. 3 after being opened.
Figure 3:
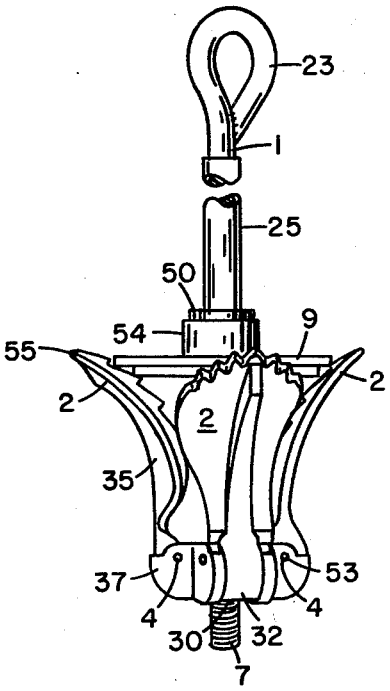
FIG. 3 is a perspective view of a 3-wing earth anchor prior to being opened.
Figure 6:
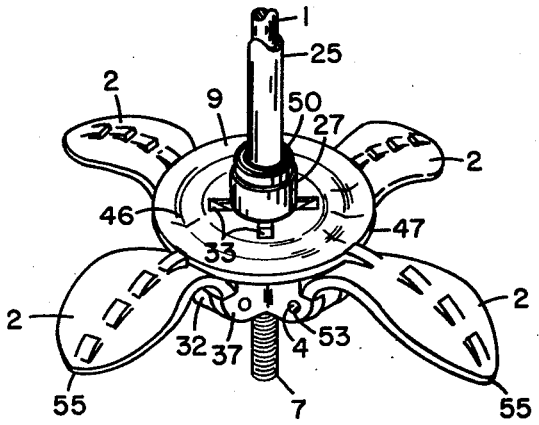
FIG. 6 is a perspective view of a 4-wing earth anchor after being opened.

Referring to FIGS. 2, 3 and 4 in combination, rod 1 is threaded at its lower end 7 to threadably receive an anchor nut 5. At the upper end of the threaded portion of the rod 1 is a steel washer 26 which is attached to rod 1 by any suitable means such as welding. Directly below the washer 26 is located an expansion plate 9. The expansion plate 9 may be formed by stamping out a circular disc from a heavy gauge sheet metal. The expansion plate 9 has a hole 45 in the center thereof which is sufficiently large to accomudate the rod 1 with some extra space therebetween. The expansion plate 9 has a W cross-sectional appearance. The W shaped appearance results from a shallow concave furrow 46 which is located approximately three-fourths of the distance from the center of the expansion plate 9 and outer edge 47. The outer slope of the furrow 46 comprises the outermost portion of the expansion plate 9. Between the expansion plate 9 and the rod 1 is an expansion plate bushing 27. The expansion plate bushing 27 is made from plastic or any other suitable insulating material. The expansion plate bushing 27 has an opening 58 to receive the rod 1 therethrough and lower projection 48 around opening 58 slightly larger than the rod 1. The outer radius of the lower projection 48 of the expansion plate bushing 27 is slightly smaller than the radius of the hole 45 of the expansion plate 9. The expansion plate bushing 27 also extends radially between the steel washer 26 and the expansion plate 9 to a point a little beyond the farthest horizontal edge of the steel washer 26. Thus, the bushing 27 fits securely around the rod 1 to electrically insulate the rod 1 and steel washer 26 from the steel expansion plate 9.

The expansion plate bushing 27 has an upper projection 54 which extends upward parallel to the rod 1 encircling the steel washer 26 therein. The expansion plate bushing 27 thus appears cross-sectionally to consist of two separate bushings connected by a washer, all being formed in one integrally molded piece. The lower projection 48 forms a small bushing between the rod 1 and the expansion plate 9. Above expansion plate 9, a washer portion of bushing 27 is located between the steel washer 26 and the expansion plate 9. And finally, the upper projection 54 of bushing 27 forms a large bushing between the steel washer 26 and the earth.

The entire length of the rod 1 above the steel washer 26 is protected by a non-conductive plastic rod sleeve 25 or other suitable insulating material. A typical example of how to protect rod 1 above washer 26 is shown in U.S. Pat. No. 3,675,381 having the same inventor as the present invention. A U shaped insulating bushing 50 is inserted between the plastic rod sleeve 25 and the expansion plate bushing 27. The U shape allows the insulating bushing 50 to be slightly compressed prior to insertion. After insertion, the U shaped insulating bushing 50 springs outward to form a tight seal between the rod sleeve 25 and the expansion plate bushing 27. The plastic rod sleeve 25, the insulating bushing 50 and the expansion plate bushing 27 form a continuous and impenetrable barrier of insulating material.

Thus, the rod 1 is electrically insulated from the earth from a point above the earth's surface to a point below the steel washer 26, and is also insulated from the expansion plate 9. The expansion plate 9 does not need to be insulated because after the anchor 3 is installed, the expansion plate 9 will no longer have a useful function.

Figure 7:
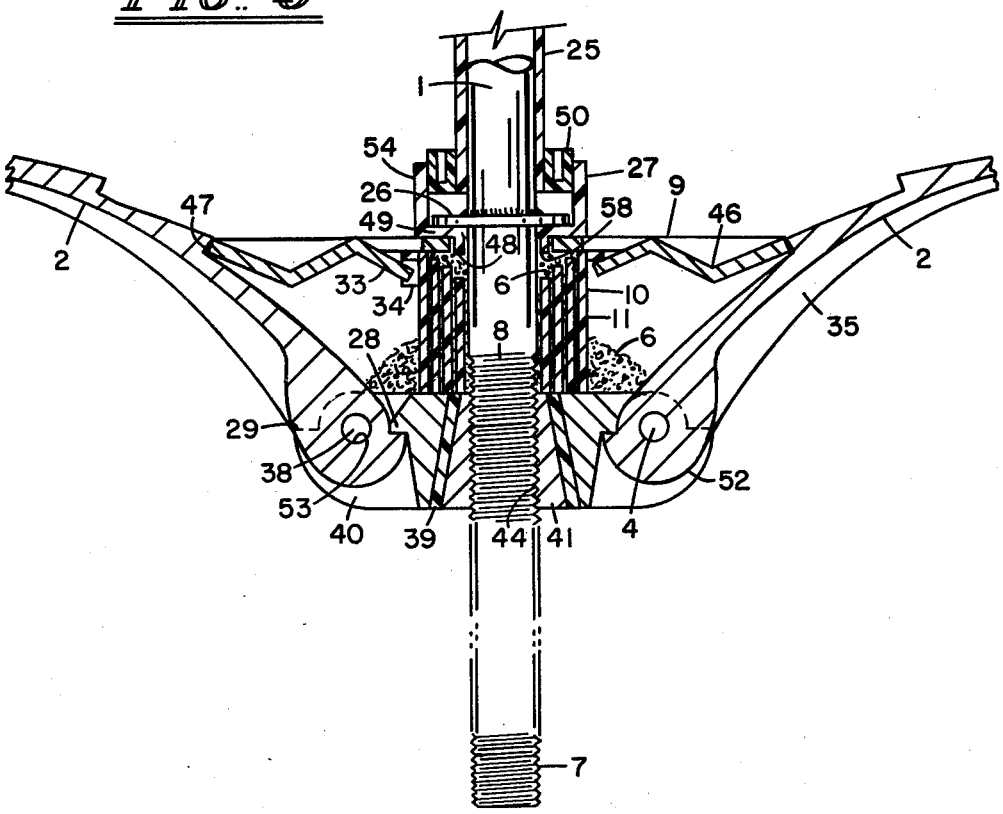
FIG. 7 is a partial elevated cross sectional view of an earth anchor embodying the present invention after installation.

A collapsible tube 10 as shown in FIGS. 2 and 7 surrounds rod 1 below expansion plate 9 and has an outer sheath 11 and an inner pliable protective substance, such as asphalt 6. The sheath 11 has a plurality of sections with this preferred embodiment containing sections 12, 13, 14, and 15, each having an increased radius respectively. The sheath sections 12, 13, 14 and 15 are connected to each other by short horizontal flanges or linkages 16, 17 and 18. The sheath 11 consists of a rigid non-conductive material, such as plastic. The linkages 16, 17 and 18 are designed to shear in consecutive order under compression force as applied by the anchor nut 5.

For reasons which are made apparent later, the strength of the linkages varies, the strongest linkage 18 being located between the largest sheath sections 14 and 15, the weakest linkage 16 being located between the smallest sheath sections 12 and 13, and all intermediate linkages (here linkage 17) being of progressive strengths in line with those above. The desired effect of this predetermined progression of strengths of the linkages 16, 17 and 18 is that when the collapsible tube 10 undergoes compression force from the anchor nut 5 parallel to the axis of the collapsible tube 10, the tube 10 collapses from the smaller end (sheath section 12) into the larger end (sheath section 15). In the collapsible tube 10 illustrated, linkage 16 would first shear allowing sheath section 12 to retreat into sheath section 13 prior to linkages 17 or 18 shearing. Similarly, linkage 17 would shear prior to linkage 18, allowing both sheath section 12 and sheath section 13 to retreat into sheath section 14. Finally, upon shearing of linkage 18 due to increased compressive forces, sheath sections 12, 13 and 14 would all retreat into sheath section 15.

The annular space 24 within the collapsible tube 10 contains a pliable non-electrically conductive substance, such as asphalt 6. Each end of the collapsible tube 10 is sealed with a paper or plastic sheet (not shown) to prevent the asphalt 6 from escaping prior to the use of the collapsible tube 10.

The collapsible tube 10 is separated from the rod 1 and anchor 3 prior to installation at the anchoring site. At the site, the lower end 7 of the rod 1 is forced by the installation personnel into the larger end of the collapsible tube 10. The rod 1 is forced vertically through the collapsible tube 10 until the larger sheath section 15 abuts the expansion plate 9 and the lower end of the rod 7 protrudes from the smaller sheath section 12.

Figure 5:
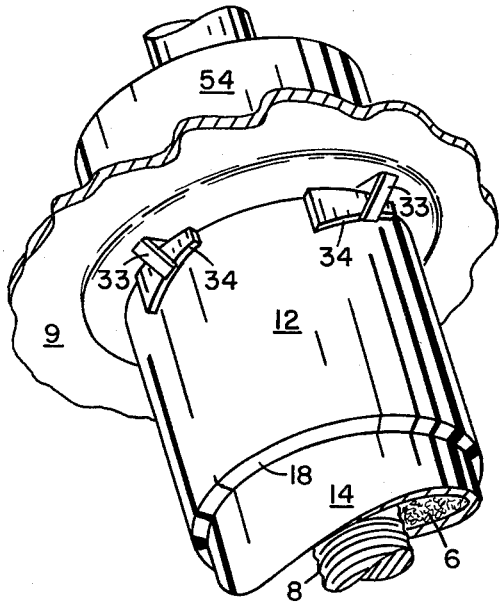
FIG. 5 is a lower perspective view of an expansion plate and collapsible tube of the earth anchor shown in FIG. 2.

In this preferred embodiment, the expansion plate 9 has four collapsible tube lugs 33 punched out on its lower side to receive four collapsible tube ramps 34 which are molded on an upper outer edge of sheath section 15 as can be seen in FIG. 5. The collapsible tube lugs 33 are punched out of the steel expansion plate 9 to form approximately a 45° angle with the expansion plate 9. The lugs 33 are of sufficient length to enable the collapsible tube ramps 34 to be securely held between the collapsible tube lugs 33 and the expansion plate 9. The collapsible tube ramps 34 consist of four short flat radial projections from the end of the collapsible tube 10. The ramps 34 are slightly inclined (approximately 10°) to form short wedges. When the collapsible tube is in place abutting the expansion plate 9, the ramps 34 also abut the expansion plate 9. The collapsible tube 10 may be twisted by installation personnel at the site so that the ramps 34 engage the lugs 33, thus wedging the ramps 34 between the lugs 33 and the expansion plate 9. This secures the collapsible tube 10 to the expansion plate 9. At this point, the collapsible tube 10 is attached and secured to the expansion plate 9 with sheath sections 11, 13, 14 and 15 being arranged concentrically about the rod 1. Lower rod threads 7 protrude from the smaller end of the collapsible tube 10 formed by sheath section 12.

The anchor 3, shown in FIGS. 2 and 7, is composed of two basic parts; anchor wings 2 and an anchor nut 5. A base 52 of the anchor wing 2 has a small surface area and relatively large cross-sectional width while the outer tip 55 of the anchor wing 2 has a broad surface area, but a very small cross-sectional width. The anchor wings 2 are quite sturdy, possibly being stamped out of heavy gauge sheet metal, or for larger anchors, being forged from cast iron and having a reinforcing anchor wing spine 35 on the back surface of the anchor wing 2. Each wing 2 is attached to the anchor nut 5 by means of an anchor pin 4 which consists of a short round metal rod. Each wing 2 has a wing socket 38 which consists of a circular hole near the base of each wing and extending therethrough. On each side of the wing socket 38 is a pin support 37 which consists of a raised rim from the anchor nut 5. Each pin support 37 has a hole 53 corresponding to the wing socket 38 in the wing base 52. When all of the elements are in place, the wing base 52 is held in place between the pin supports 37 by the pin 4 which is within the wing socket 38, either end of the pin 4 being secured by the adjacent pin supports 37.

The anchor nut 5 is composed of three parts; an inner nut 41, a nut bushing 39 and an outer nut 40. The inner nut 41 is conically shaped, the smaller end being at the top of the inner nut 41. The inner nut 41 is composed of metal and contains on its inner surface threads 44 which engage the lower rod threads 7. The outer surface of the inner nut 41 abuts a conical plastic bushing 39 which in turn abuts the outer nut 40. The three parts are joined together by a strong adhesive, one conical portion closely fitting on top of the next to form an earth anchor nut as one integral unit.

The purpose of the plastic bushing 39 is to electrically insulate the rod 1 from the majority of the anchor 3 and thus reduce electrolitic corrosion. The purpose of the conical arrangement of three parts of the anchor nut 5 is to insure that the outer nut 40 is unable to slip off the inner nut 41 once the inner nut 41 is threadably engated with the rod 1 or advanced up the rod 1 due to rotation of the rod 1.

The purpose of bonding the three parts of the anchor nut 5 together with adhesive is to insure that the inner nut 41 would not spin inside of outer nut 40 thereby causing the wings 2 of the anchor 3 to open as will be more fully explained hereinafter.

At the site for using the entire anchoring apparatus, the anchor 3 is threadably engaged upon the lower rod threads 7 after the collapsible tube 10 has been attached to the expansion plate 9 so that the anchor nut 5 firmly abuts the collapsible tube 10. The entire anchoring apparatus is now assembled and ready for on-site use. A partial cross-sectional view of the assembled apparatus is seen in FIG. 2. Notice that the anchor wings 2 may touch the outer edge 47 of the expansion plate 9. When viewed as a whole, the apparatus resembles a "V." Because of this configuration, the apparatus may be very easily forced into a previously drilled hole in the earth.

The anchor 3 is used by inserting it in the previously drilled hole. When the anchor 3 reaches the desired depth, the rod 1 is rotated at the surface. The anchor nut 5 does not rotate because the anchor wings 2 to which it is attached grip the sides of the surrounding earthen hole. Teeth 36 of anchor wing 2, which consist of metal projections protruding from the tips of the wings 52, grip the earth during the initial rotations. After a few rotations, the anchor wings 2 begin to imbed themselves into the surrounding earth.

The rotation of the rod 1 through the anchor nut 5 and the accompanying movement of the rod 1 down through the anchor nut 5 has two primary effects. As the rod 1 is rotated through anchor nut 5, the rod 1 advances through the anchor nut 5 and the distance between the steel expansion plate 9 and the anchor nut 5 becomes shorter. The radius of the anchor nut 5 is smaller than the radius of the steel expansion plate 9. Because the radius of the anchor nut 5 to which the anchor wings 2 are attached at base 52 is less than the outer radius of the steel expansion plate 47, as the distance between the anchor nut 5 and the steel expansion plate 9 decreases, the outer edge 47 of the steel expansion plate 9 forces the anchor wings 2 outward from the rod 1. This forces the anchor wings 2 into the earth which securely fixes the anchoring apparatus to a permanent location.

As the anchor wings 2 are forced away from the axis of the rod 1 and into the surrounding soil, the horizontal surface area of the earth anchor is increased. The large surface area of the anchor wings 2, which previously laid essentially vertical along the rod, opens to a position generally perpendicular to the axis of the rod 1 thereby extending into the earth. A greater amount of soil must be displaced before the earth anchor 3 can be pulled from the earth. Thus, the primary purpose of rotating the rod 1 through the nut 5 is to securely position the anchor wings 2 of the earth anchor 3 within the earth.

Further, as the expansion plate 9 advances toward the anchor nut 5 due to the rotation of the rod 1 through the anchor nut 5, the collapsible tube 10 is compressed between the anchor nut 5 and expansion plate 9. This compression presses the asphalt 6 against the upper rod threads 6 thus further insulating the threads from any contact with the earth. Continued rotation of the rod 1 and increasing pressure upon the collapsible tube 10 finally shears the linkages 16, 17 and 18, respectively, between the different sheath sections 12, 13 14 and 15. The linkages are designed and constructed to shear in a sequence beginning with linkage 16 adjacent to the nut and ending with the linkage 18 furthest from the nut. This may be accomplished by the difference in cross-sectional areas of the various linkages 16, 17 and 18. Because the upper sheath section 15 remains attached to the expansion plate 9, by the expansion plate lugs 33 and the collapsible tube ramps 34, the collapsible tube 10 does not fall down as the linkages are sheared. Also, due to the attachment, the sheaths 12, 13, 14, and 15 remain concentrically arranged about the rod 1 and continue to protect the rod 1 against damage from rocks, etc. The radii of the sheath sections 12, 13, 14 and 15 are sufficiently dissimilar in length to allow the excess asphalt 56 to escape from the collapsible tube 10 as it telescopes together; thus allowing the wing 2 to be opened without undue resistance from the telescoping collapsible tube 10.

The pins 4 are no longer functional elements of the anchor 3 once installed. FIG. 4 illustrated the fully expanded position of the earth anchor 3. The toe 30 of the anchor wing 2, which is a small metal tab protruding from the underside of the anchor wing base 52, now firmly abuts an upper anchor stop 28. The upper anchor stop 28 is an element of the outer nut 40 and is positioned to halt the upward movement of the toe 30 as the wing 2 of the anchoring apparatus are fully opened. Further, the anchor wing 2 now also abuts a lower anchor stop 29, which is also part of the outer nut 40 as shown in FIG. 4. The lower anchor stop 29 halts the downward movement of the anchor wing 2 after the anchor wing 2 are fully expanded. When total expansion is achieved, the upper anchor stop 28 and lower anchor stop 29 halt the upper and lower torques exerted by the anchor wing 2 on the pin 4. Since the cable 19 attached to the anchoring apparatus continually pulls on the earth anchor 3, forces will continually be exerted on the stops 28 and 29, but not on pin 4. Since the pin 4 no longer has a function once installed, the pin 4 does not have to be protected.

The present invention permits the anchor wings 2 to open and penetrate the earth while continuing to keep the upper threads 8 electrically insulated and protected from corrosion. This protection continues regardless of the number of times the rod 1 is rotated through the anchor nut 5 until the wings 2 are fully open. Since the lower threads 7 no longer have a function, lower threads 7 are left unprotected.

After completion of the entire anchoring process, the rod 1 is insulated from a point above the surface of the earth down to the lowest point of the rod 1 which is still necessary for the anchoring function. The rod sheath 25, insulation bushing 50, expansion plate bushing 27, collapsible tube 10, asphalt 6 and plastic anchor bushing 39 collectively form a continuous barrier between the earth and the rod 1 except on the lower tip thereof which is non-functional. Since no other portion of the rod 1 electrically connects to the earth, there is no path for current flow through the exposed lower tip to cause electrolysis.

I claim:

1. An earth anchor adapted for attachment to a cable that pulls in a first direction generally parallel to a longitudinal axis of said earth anchor upon installation in the earth, said earth anchor comprising:
   - a rod extending along said longitudinal axis of said earth anchor, an upper end of said rod having means for attachment to said cable;
   - an anchor nut threadably attached to a lower end of said rod;
   - wing means pivotably attached to said nut means;
   - plate means retained on said rod and spaced above said anchor nut, said plate means being generally perpendicular to said longitudinal axis;
   - collapsible cylinder means located concentrically about said rod and abutting said plate means and said anchor nut on opposite ends thereof; and
   - insulating means about said rod for insulating said rod above said anchor nut from the earth, some of said insulating means being a pliable substance contained inside of said collapsible cylinder means.

2. The earth anchor as recited in claim 1 wherein said collapsible cylinder means includes a plurality of sheath sections of dissimilar radii attached together by connecting means, said connecting means being designed to release said sheath sections in a predetermined order to allow said sheath sections to telescope closed upon application of increasing amounts of compressive force generated by rotating said rod inside of said anchor nut.

3. The earth anchor as recited in claim 1 or 2 wherein said pliable substance is tar.

4. The earth anchor as recited in claim 2 wherein said connecting means are radially extending linkages between said sheath sections, said linkages shearing in said predetermined order under said increasing amounts of said compression force.

5. The earth anchor as recited in claims 1, 2 or 4 wherein said collapsible cylinder means includes attachment means for securing said collapsible cylinder means to said plate means.

6. The earth anchor as recited in claim 5 wherein said attachment means includes wedges located on an uppermost end of said collapsible cylinder means rotatably locking with tabs formed on a lower side of said plate means.

7. The earth anchor as recited in claim 1 wherein said insulating means includes an insulating cylinder around said rod above said plate means, bushing means between said plate means, and stop means on said rod for insulating said plate means from said rod, said stop means preventing said plate means from moving further upward on said rod after assembly of said earth anchor.

8. A collapsible cylinder for use in protecting threads of an earth anchor comprising:

a plurality of sheath sections of dissimilar radii, said sheath sections having a generally cylindrical shape with open ends;

a plurality of linkage means extending radially outward from respective ends of said sheath sections to connect to adjacent said sheath sections with said collapsible cylinder resembling an expanded telescope;

said linkage means being designed to shear in a predetermined order under increasing compressive forces applied upon ends of said collapsible cylinder, shearing of said linkage means causing said collapsible cylinder means to close in a predetermined telescoping manner with smaller members of said sheath sections being received inside of adjacent larger members of said sheath sections.

9. The collapsible cylinder for use in protecting threads of an earth anchor as given in claim 8 wherein thickness of each linkage means is essentially uniform.

10. The collapsible cylinder for use in protecting threads of an earth anchor as given in claim 8 wherein said collapsible cylinder is filled with pliable tar retained therein by rupturable membranes covering each end of said collapsible cylinder.

11. The collapsible cylinder for use in protecting threads of an earth anchor as given in claim 10 comprising wedge means attached to an uppermost outer edge of said collapsible cylinder, said wedge means being adapted to lock with tabs of an expansion plate of said earth anchor.

12. A method of installing an earth anchor in earth for attachment to a cable that pulls in a first direction generally parallel to a longitudinal axis of said earth anchor, installation steps consisting of the following:

first abutting an expansion plate against a stop on a threaded end of an anchor rod, bushing means insulating said expansion plate from said anchor rod;

second abutting an upper end of collapsible cylinder means against a lower side of said expansion plate, said collapsible cylinder means being filled with a pliable insulating substance which encapsulates said threaded end;

threading an anchor nut on said threaded end for third abutting of a lower end of said collapsible cylinder means, said anchor nut having anchor wings pivotably connected thereto, upper ends of said anchor wings pressing against sides of said expansion plate;

inserting said earth anchor in the earth;

rotating said anchor rod thereby causing said anchor nut to thread upward on said threaded end; and simultaneously telescoping said collapsible cylinder means closed by increasing compressive forces between said anchor nut and said expansion plate, said anchor wings being pivoted outward into the earth by said expansion plate.

13. The method of installing an earth anchor as given in claim 12 including as part of said telescoping step shearing connections between sheath sections of said collapsible cylinder means in a predetermined order.

14. The method of installing an earth anchor as given in claims 12 or 13 including after said second abutting step further step of securing said collapsible cylinder means to said expansion plate.

15. The method of installing an earth anchor as given in claim 14 wherein said securing step includes rotating said collapsible cylinder means to lock wedges thereon with locking tabs of said expansion plate.

16. The method of installing an earth anchor as given in claim 13 including as part of said second abutting step rupturing thin membranes on each end of said collapsible cylinder means, said membrane retaining said pliable insulating substance inside said collapsible cylinder means prior to assembly.

* * * * *